United States Patent [19]

Tofte

[11] Patent Number: 4,747,142

[45] Date of Patent: May 24, 1988

[54] THREE-TRACK STEROPHONIC SYSTEM

[76] Inventor: David A. Tofte, 1445 SE. Maple, Milwaukie, Oreg. 97222

[21] Appl. No.: 758,770

[22] Filed: Jul. 25, 1985

[51] Int. Cl.[4] ..... H04S 3/00

[52] U.S. Cl. ..... 381/27; 381/106

[58] Field of Search ..... 381/1, 27; 333/106, 333/98, 14

[56] References Cited

U.S. PATENT DOCUMENTS

| | | | |
|---|---|---|---|
| 3,679,832 | 7/1972 | Halpern | 381/14 |
| 4,024,344 | 5/1977 | Dolby et al. | 381/27 |
| 4,074,083 | 2/1978 | Berkovitz et al. | 381/27 |
| 4,293,821 | 10/1981 | Bourdouris et al. | 381/27 |
| 4,442,546 | 4/1984 | Ishigaki | 381/106 |
| 4,498,060 | 2/1985 | Dolby | 381/106 |

*Primary Examiner*—Forester W. Isen

[57] ABSTRACT

In a stereophonic reproduction system, a true center-channel signal is derived by combining the left and right signals into a monophonic signal, and canceling and overriding this monophonic signal with a second modified monophonic signal, the latter derived by combining properly bandpassed left and right signals that have been compressed, combined, and expanded. True left- and true right-channel signals are subsequently derived by subtracting the true center-channel signal voltage from the left and right signal voltages.

1 Claim, 1 Drawing Sheet

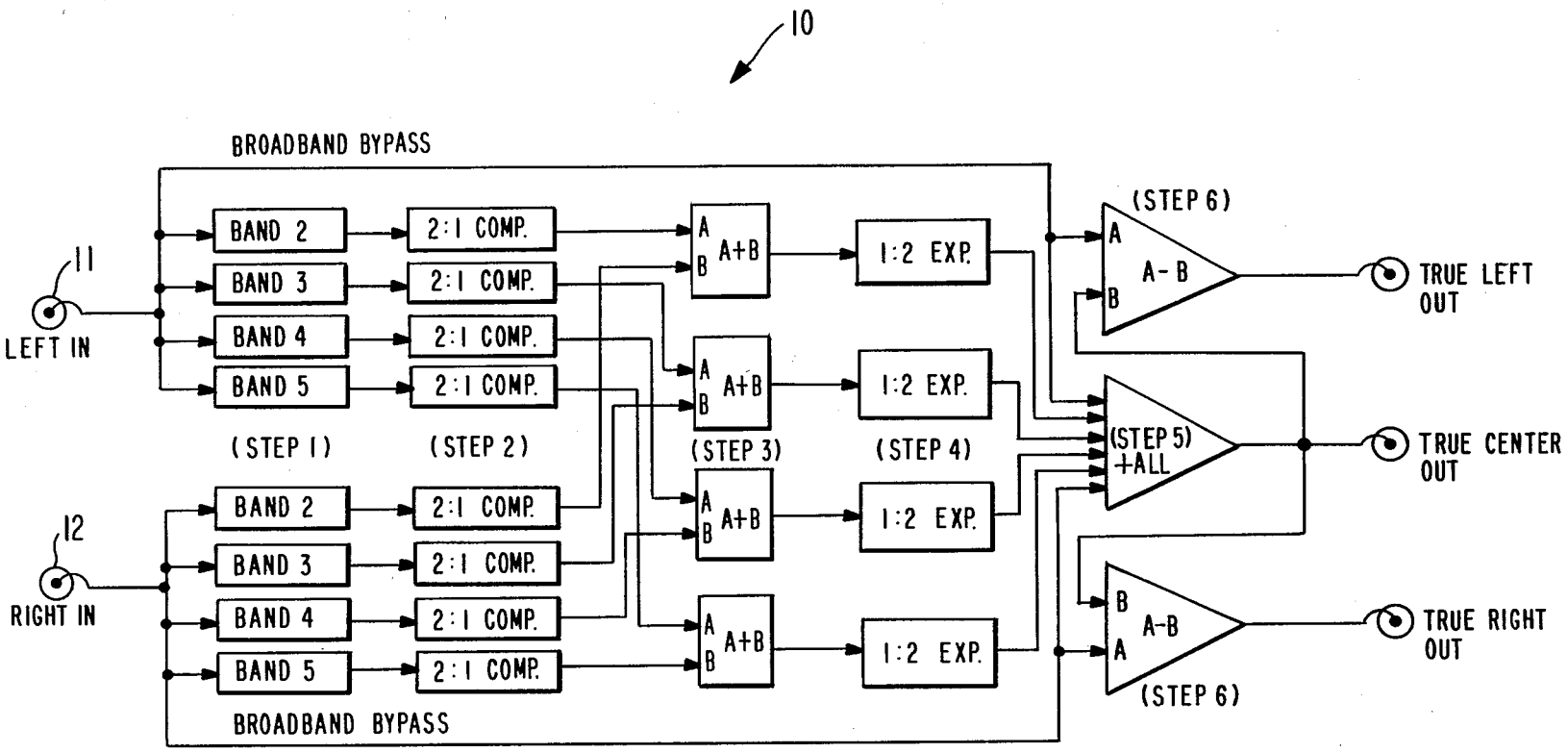
10
11
LEFT IN
12
RIGHT IN
BROADBAND BYPASS
BAND 2
BAND 3
BAND 4
BAND 5
(STEP 1)
2:1 COMP.
(STEP 2)
A+B
(STEP 3)
1:2 EXP.
(STEP 4)
(STEP 5)
+ALL
A-B
(STEP 6)
TRUE LEFT OUT
TRUE CENTER OUT
TRUE RIGHT OUT

THREE-TRACK STEROPHONIC SYSTEM

BACKGROUND OF THE INVENTION

1. Field of the Invention

This invention relates to stereophonic systems, and more particularly, to a three-track stereophonic system.

2. Description of Prior Art

Reference U.S. Pat. Nos. 3,679,832, Halpern, Berkovitz et al 4,074,083, Boudouris et al 4,293,821, and Dolby et al 4,024,344. The references disclose hardened, correllated, and compared center channel signals. The system in accordance with the present invention enables a true center-channel signal to be derived, by combining the left and right signals into a monophonic signal and cancelling and overriding this monophonic signal with a second monophonic signal, and the latter is derived by combining properly bandpassed left and right signals that have been compressed, and expanded. True left-and true right-channel signals are subsequently derived by subtracting the true center-channel signal voltage from the left and right signal voltages.

The principal object of this invention is to provide a three-track stereophonic system that will be a unique and novel electronic system designed to enhance the special characteristics of true stereophonic reproduction of sound, via standard stereo two-track sources, such as, tape, disc, film, and the like, by reprocessing the two-track format into three and possibly more distinct sound sources, without sacrificing the integrity of the original stereophonic recording. The present invention is engineered around the capable function block devices of the Signetics NE570N compandor and the ubiquitous National LM324 quad operational amplifier, without which, would be impractical in terms of moderate cost to the consumer.

Another object of this invention is to provide a three-track stereophonic system, which will overcome the obstacles in performance associated with antedated three-track systems which employ derived-channel monophonic circuitry in producing a third center channel sound track, and the present invention in essence, will produce a true center channel sound track, sonically and divorced from the reproduced stereophonic image, without the use of psycho-acoustic principles or gimmicks, and will demonstrate a freedom of flexibility, comparable to commercial multi-track sound systems beyond the reach of the average consumer, with the exception, of theaters, concert halls, and expensive multi-track home systems.

DESCRIPTION OF THE DRAWING

The drawing is a block diagram and is the sole illustration of the present invention.

SUMMARY OF THE INVENTION

The present invention comprises an electronic stereophonic reproduction system, wherein a conventional stereo sound source, such as an FM stereo tuner, or a tape deck, has its dual signal voltages each divided into four passbands by filter networks, plus a broadband bypass, making five circuit paths for each sound track, and a true center-channel signal is derived by combining the left and right signals into a monophonic signal, and canceling and overriding this monophonic signal with a second modified monophonic signal, the latter derived by combining properly bandpassed left and right signals that have been compressed, combined, and expanded. True left-and true right-channel signals are subsequently derived by substracting the true central-channel signal voltage from the left and right signal voltages.

DETAILED DESCRIPTION

Accordingly, a system 10 is shown to include the conventional left input 11 and the right input 12, and the steps that are taken to produce system 10, are as follows:

Step 1. A conventional stereo sound source, such as an FM stereo tuner, or a tape deck, has its dual signal voltages each frequency-divided into four passbands by Butterworth filter networks, plus a broadband bypass, making five circuit paths for each sound track, which is not considered novel per se. The two tracks are separated in the following manner of cut-off:

(Band 1) 20–20,000 Hz (broadband)
(Band 2) 20–112 Hz (bassband)
(Band 3) 112–632 Hz (mid-bassband)
(Band 4) 632–3500 Hz (mid-trebleband)
(Band 5) 3500–20,000 Hz (trebleband)

Step 2. Each of the four passbands (bands 2–5 of both given tracks are administered dynamic 2:1 logarithmic compression about a unity-gain axis of 0 dBm (0.775V RMS). For this, the Signetics NE570N compandor is used in the compressor mode of operation (not considered novel per se; reference being had to Signetics Analog Data Manual 1983, p. 5–9). Also, the compressors both increase the voltage level of the compressed outputs by +6 db for all eight passband signals, and invert their respective initial phases, via the op-amps in the compressor circuits (not considered novel per se; Ibid. p. 5–9). The dynamic 2:1 compression acts upon the average rectified signal levels of each passband, and there are eight total individual compressors. Step 3. Having four pairs of compressed bandpass stereo signal voltages, each paired bandpass is combined into a single composite bandpass voltage at the compressor outputs, resulting in four compressed bandpass composite ("mono") signal voltages. (This is not considered novel per se; however, note that the average level of power in the stereo signal modulation drops by 6 db in the process of mixing the stereo signal to the single composite voltage. The average power level of the mono signal modulation remains the same before and after the mixing process.) There is a net voltage attenuation of 3 db due to the resistance of the mixing network, offsetting the previous amplification of the compressors to a final level of +3 db.

Step 4. Each of the four bandpassed, compressed composite signals are administered dynamic 1:2 logarithmic expansion about a unity-gain axis of OdBM (0.775V RMS). For this, the Signetics NE570N is used again, this time in the expander mode of operation (Ibid., p. 5–8). The dynamic 1:2 expansion acts upon the average rectified signal levels of the four passbands, so there are four individual expandors. Expandor gains are set at +0 db; given the previous level gains of +3 db after the mixing process, the signal levels as a result of 1:2 expansion now ride at +6 db. The expandors, at this point, operate as current amplifiers only; the current-to-voltage conversion is accomplished by a single operational amplifier in the next step of the process, which is considered to be the critical point of the process, both in its operation and in its novelty.

Step 5. The four bandpassed composite signals of the expandors of Step 4., as well as the two broadband bypass signals of Step 1., are all added together to make a single composite signal. This composite signal is the true center channel output, which can be amplified for driving a third center loudspeaker in a stereophonic sound system.

It shall be recognized, that system 10 produces a true center channel, because the original monophonic modulations of the stereophonic source signal are retained to the exclusion of all other source modulations. This effect cannot be attained by simply mixing the stereo tracks to mono, for while the stereo effect itself has disappeared in mixing, the average power level in the stereo effect does not drop off into infinity, but only drops by 6 db.

The two broadband bypass signals are summed together at the summing mode of a single operational amplifier, making a single mono signal, but this in itself is not the true center-channel output. The preceding steps 1 to 4 outline the making of a slightly different form of mono-signal, which is summed into the summing mode along with the broadband bypass signals, and cancelling and overriding the bypass signals by virtue of being larger in amplitude and out of phase with them.

Step 6. Having isolated the common monophonic modulation from the stereo fine signal in the form of a true center channel, it is then a fairly simple matter to subtract the center channel voltage from the stereo line voltages, producing a true left channel and a true right channel, for driving left and right loudspeakers through a stereo amplifier. This can be accomplished by operational amplifiers operating in the differential (differencing) mode. (Not considered novel per se; reference being had to National Linear Applications Vol. 1, p. AN31-1).

For some time now, it has been assumed by audio equipment designers that the proper means of deriving a third center channel sound source in a stereophonic system is to simply combine the stereo signals to mono, and call this the center channel. In reference to this assumption, some manufacturers, such as Dynaco, have made public certain limitations in the potential performance of all 3-track sound systems derived from 2-track formats. The following excerpt, for example, appears in literature for Dynaco audio equipment:

"It should be recognized, however, that a two channel system will have a wider apparent sound source than any system utilizing a center speaker in a derived third channel arrangment, if the spacing between the left and right channel speakers remains the same. In order to maintain the equivalent spread of sound, somewhat greater spacing between the outside speakers is required in any 3 speaker system."(From Dynaco Literature #909018, p. 11)

It shall also be recognized, that the present invention could be likened to a reversal of the studio's mix-down process, where many separate microphone signals are "panned" onto a final master tape through a mixing console equipped with individual balance controls for changing the apparent position of each microphone in the stereo image.

Psycho-acoustic phenomena is secondary in nature to the design of system 10, because system 10 is meant to convey a solid wall of sound to the listener; what the listener wants to hear, or meant to hear, is not the function of the present invention, but is a beneficial by-product of the process.

It shall further be recognized, that a high-impedance buffer stage may be incorporated at the left-in and right-in termini, if desired.

In operation, the left input 11 and the right input 12, have their dual signal voltages, each frequency divided into the four passbands and the broadband bypasses, and each passband feeds into its compressor. Each coupled compressor then feeds its respective signal into the expandors and the output of the expandors feed into their center amplifier, as also the broadband bypasses, while simultaneously, the broadband bypasses feed into their left and right amplifiers.

While various changes may be made in the detail construction, such changes will be within the spirit and scope of the present invention, as defined by the appended claims.

What I now claim is:

1. A three-track stereophonic system, comprising:

a stereo source having left and right channels; first and second groups of pass-band filters, each group comprising a plurality of filters, the inputs of the filters of said first group being responsive to said left channel, and the inputs of the filters of said second group being responsive to said right channel;

a plurality of compressors, each compressor having its input coupled to a corresponding output of each filter, and each compressor administering a 2:1 logarithmic compression to the signal input thereto;

a plurality of expanders responsive to the outputs of said compressors;

a central amplifier means responsive to the outputs of said expanders to provide a third channel.

* * * * *